US010101015B2

(12) United States Patent
Benghozi et al.

(10) Patent No.: US 10,101,015 B2
(45) Date of Patent: Oct. 16, 2018

(54) FIRE PROOF RECESSED LIGHT FIXTURE

(71) Applicant: BAZZ INC., Saint-Laurent (CA)

(72) Inventors: Simon Benghozi, Montreal (CA); Sebastien Allen, St-Lazare (CA)

(73) Assignee: BAZZ INC., Saint-Laurent (CA)

( * ) Notice: Subject to any disclaimer, the term of this patent is extended or adjusted under 35 U.S.C. 154(b) by 0 days.

(21) Appl. No.: 15/613,753

(22) Filed: Jun. 5, 2017

(65) Prior Publication Data

US 2017/0350582 A1 Dec. 7, 2017

Related U.S. Application Data

(60) Provisional application No. 62/346,743, filed on Jun. 7, 2016.

(51) Int. Cl.

| | |
|---|---|
| ***F21S 8/00*** | (2006.01) |
| ***F21V 25/12*** | (2006.01) |
| ***F21S 8/02*** | (2006.01) |
| ***F21V 15/01*** | (2006.01) |
| ***F21V 21/04*** | (2006.01) |
| *F21V 27/00* | (2006.01) |

(52) U.S. Cl.

CPC ..... *F21V 25/12* (2013.01); *F21S 8/026* (2013.01); *F21V 15/01* (2013.01); *F21V 21/047* (2013.01); *F21V 27/00* (2013.01)

(58) Field of Classification Search

CPC .. F21S 8/02; F21S 8/026; F21V 25/00; F21V 25/12; F21V 21/048; F21V 15/01; F21V 29/15; F21V 15/00; F21V 21/047; F21V 25/125

USPC ..... 362/147

See application file for complete search history.

(56) References Cited

U.S. PATENT DOCUMENTS

| | | | | | |
|---|---|---|---|---|---|
| 4,237,671 | A | * | 12/1980 | Munson | E04F 19/00 52/28 |
| 4,400,766 | A | * | 8/1983 | Munson | F21S 8/02 362/294 |
| 5,257,775 | A | * | 11/1993 | Burns | E04B 9/006 269/102 |
| 5,548,497 | A | * | 8/1996 | Cho | F21S 8/026 362/260 |

(Continued)

OTHER PUBLICATIONS

OA U.S. Appl. No. 29/567,244 dated Sep. 22, 2017.
Notice of Allowance U.S. Appl. No. 29/567,242.

*Primary Examiner* — Thien M Le
(74) *Attorney, Agent, or Firm* — Gonzalo Lavin

(57) ABSTRACT

A fireproof recessed light fixture for receiving a light source comprises a metal housing defining an open end for receiving the light source and a closed end. The housing comprises an annular shoulder at the open end for abutting a wall into which the recessed light fixture is installed. The housing comprises a first wall of generally cylindrical shape extending between the open and closed ends and a second wall defining the closed end of the housing. Both first and second walls have thicknesses between 0.5 and 1 mm and are completely sealed so to prevent air flow between an interior and an exterior of the housing other than through the open end and through an opening for feeding through cables for electrical energy supply. The first and second walls render the recessed light fixture fireproof by preventing high temperatures or fire from propagating quickly through the housing.

8 Claims, 6 Drawing Sheets

(56) References Cited

U.S. PATENT DOCUMENTS

| | | | | |
|---|---|---|---|---|
| D383,564 | S | 9/1997 | Lecluze | |
| 6,357,891 | B1 * | 3/2002 | Newbold | F21S 8/02 362/147 |
| D473,966 | S | 4/2003 | Lecluze | |
| D488,251 | S | 4/2004 | Benghozi | |
| D548,390 | S | 8/2007 | Lecluze | |
| D601,740 | S | 10/2009 | Seo | |
| D606,696 | S | 12/2009 | Chen | |
| D609,840 | S | 2/2010 | Tang | |
| D622,434 | S | 8/2010 | Ward | |
| D640,819 | S | 6/2011 | Pan | |
| D665,117 | S | 8/2012 | Yoshida | |
| D668,372 | S | 10/2012 | Renshaw | |
| D671,668 | S | 11/2012 | Rowlette, Jr. | |
| D684,288 | S | 6/2013 | Gielen | |
| D694,456 | S | 11/2013 | Rowlette, Jr. | |
| D714,989 | S | 10/2014 | Rowlette, Jr. | |
| D723,153 | S | 2/2015 | Borkholder | |
| D724,775 | S | 3/2015 | van Dijk | |
| D731,689 | S | 6/2015 | Bernard | |
| D767,809 | S | 9/2016 | Gotz-Schafer | |
| D772,466 | S | 11/2016 | Zhang | |
| D773,097 | S | 11/2016 | Zhao | |
| D782,721 | S | 3/2017 | Cohen | |
| 2002/0157324 | A1 * | 10/2002 | Newbold | F21S 8/02 52/27 |
| 2007/0206374 | A1 * | 9/2007 | Petrakis | F21S 8/02 362/147 |
| 2008/0170404 | A1 * | 7/2008 | Steer | F21S 8/02 362/365 |
| 2012/0218764 | A1 * | 8/2012 | Williamson | F21V 29/20 362/294 |

* cited by examiner

Temperature Data (Furnace and Unexposed Temperatures)

| | Ambient | Furnace Temperatures (°F) | | | | Unexposed Surface Temperatures (°F) | | | | | Average (°F)) |
|---|---|---|---|---|---|---|---|---|---|---|---|
| T/C | 1 | 2 | 3 | 4 | 5 | 6 | 7 | 8 | 9 | 10 | 6-10 |
| Time (hr:min) | | | | | | | | | | | |
| 0:00 | 62 | 55 | 55 | 56 | 54 | 60 | 60 | 60 | 61 | 61 | 60 |
| :05 | 63 | 892 | 1010 | 972 | 988 | | | | | 61 | |
| :10 | 63 | 1241 | 1288 | 1321 | 1286 | | | | | 62 | |
| :15 | 66 | 1388 | 1430 | 1454 | 1439 | 69 | 69 | 68 | 66 | 64 | 67 |
| :20 | 66 | 1407 | 1438 | 1456 | 1444 | 71 | 71 | 69 | 69 | 65 | 69 |
| :25 | 66 | 1402 | 1437 | 1447 | 1440 | 75 | 75 | 72 | 74 | 68 | 73 |
| :30 | 65 | 1426 | 1463 | 1479 | 1470 | 79 | 79 | 75 | 78 | 72 | 77 |
| :35 | 66 | 1442 | 1481 | 1503 | 1486 | 85 | 84 | 79 | 83 | 77 | 82 |
| :40 | 66 | 1473 | 1509 | 1554 | 1513 | 91 | 88 | 82 | 88 | 81 | 86 |
| :45 | 67 | 1499 | 1529 | 1574 | 1534 | 96 | 92 | 86 | 94 | 87 | 91 |
| :50 | 66 | 1528 | 1564 | 1608 | 1579 | 102 | 96 | 90 | 99 | 91 | 96 |
| :55 | 67 | 1551 | 1588 | 1628 | 1590 | 107 | 100 | 93 | 103 | 96 | 100 |
| 1:00 | 68 | 1594 | 1624 | 1688 | 1640 | 111 | 103 | 95 | 106 | 99 | 102 |
| 1:05 | 67 | 1633 | 1710 | 1706 | 1710 | 122 | 116 | 104 | 118 | 108 | 113 |
| 1:10 | 67 | 1660 | 1709 | 1733 | 1739 | 124 | 118 | 106 | 119 | 110 | 115 |
| 1:15 | 70 | 1677 | 1736 | 1753 | 1744 | 126 | 122 | 109 | 121 | 112 | 118 |
| 1:20 | 70 | 1682 | 1737 | 1760 | 1741 | 129 | 130 | 113 | 123 | 113 | 122 |
| 1:25 | 69 | 1684 | 1740 | 1761 | 1768 | 132 | 129 | 119 | 125 | 134 | 128 |
| 1:30 | 68 | 1685 | 1740 | 1777 | 1750 | 136 | 139 | 123 | 118 | 107 | 125 |
| 1:35 | 68 | 1671 | 1722 | 1780 | 1726 | 134 | 143 | 129 | 131 | 115 | 130 |
| 1:40 | 67 | 1674 | 1723 | 1768 | 1731 | 143 | 154 | 133 | 140 | 124 | 139 |
| 1:45 | 69 | 1667 | 1713 | 1749 | 1716 | 150 | 158 | 137 | 148 | 133 | 145 |
| 1:50 | 70 | 1664 | 1706 | 1760 | 1708 | 156 | 161 | 140 | 154 | 138 | 150 |
| 1:55 | 70 | 1745 | 1812 | 1813 | 1830 | 161 | 164 | 141 | 160 | 142 | 154 |
| 2:00 | 70 | 1747 | 1800 | 1814 | 1851 | 165 | 168 | 147 | 165 | 146 | 158 |

FIG. 5

FIRE PROOF RECESSED LIGHT FIXTURE

CROSS-REFERENCE TO RELATED APPLICATIONS

This application claims benefit of U.S. provisional application Ser. No. 62/346,743, filed on filed Jun. 7, 2016, which is incorporated herein in its entirety by reference.

FIELD OF THE INVENTION

The present invention relates to a recessed light fixture. More specifically, the present invention is concerned with providing a fireproof recessed light fixture.

BACKGROUND OF THE INVENTION

In order to fireproof a recessed light fixture, it is known in the art to mount the recessed light fixture in a structure, for example a box, which is fireproof and which surrounds the recessed light fixture when mounted. In the context of fireproofing, it is also known to provide an intumescent, for example a coating that expands when heated.

SUMMARY OF THE INVENTION

In accordance with the present invention, there is provided a fireproof recessed light fixture for receiving at least one light source. The recessed light fixture comprises a metal housing defining an open end, through which the light source can be received, and a closed end. The metal housing is preferably made of steel with rust protection. The housing further comprises an annular shoulder at the open end for abutting a wall into which the recessed light fixture can be installed. The housing comprises a first wall of generally cylindrical shape extending between the open and closed ends, the first wall having a first wall thickness between 0.5 mm and 1 mm. The housing comprises a second wall defining said closed end of said housing, the second wall having a second wall thickness between 0.5 mm and 1 mm. The first and second walls are sealed so as to prevent air flow between an interior of the housing and an exterior of the housing other than through the open end and through an opening for feeding through cables for electrical energy supply. The first and second walls render the recessed light fixture fireproof by preventing high temperatures or fire from propagating quickly through the housing.

In an embodiment, the recessed light fixture further includes a cover member for covering at least the annular shoulder of the housing and for providing an aesthetic appearance of the recessed light fixture when installed.

In an embodiment, the recessed light fixture further comprises a fixation assembly for mounting the recessed light fixture on a mounting wall, the fixation assembly comprising a box bearing a screw by means of a bottom box wall and a rib, the screw rotatable about a screw axis, the screw comprising a screw head for driving the screw about the screw axis, and a wing comprising two flaps, each of the flaps comprising a threaded bore engageable with the screw, wherein upon rotation of the screw, the wing rotates together with the screw into a substantially radial position of the wing until a stop is reached, and wherein upon reaching the stop and upon further rotation of the screw, the wing moves along the screw axis until engaging with the mounting wall.

In an embodiment, the thickness of the first wall of the recessed light fixture is between 0.60 mm and 0.80 mm, preferably 0.75 mm.

In an embodiment, the thickness of the second wall of the recessed light fixture is between 0.60 mm and 0.80 mm, preferably 0.75 mm.

Advantageously, the recessed light fixture may achieve a 2 hour fire endurance rating as per ASTM E119 standards.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIG. 5 is a graph representing the results from a fire endurance test of the recessed light fixture, in accordance with a preferred embodiment of the invention.

DESCRIPTION OF ILLUSTRATIVE EMBODIMENTS

The present invention is illustrated in further details by the following non-limiting examples.

Figure 1A:
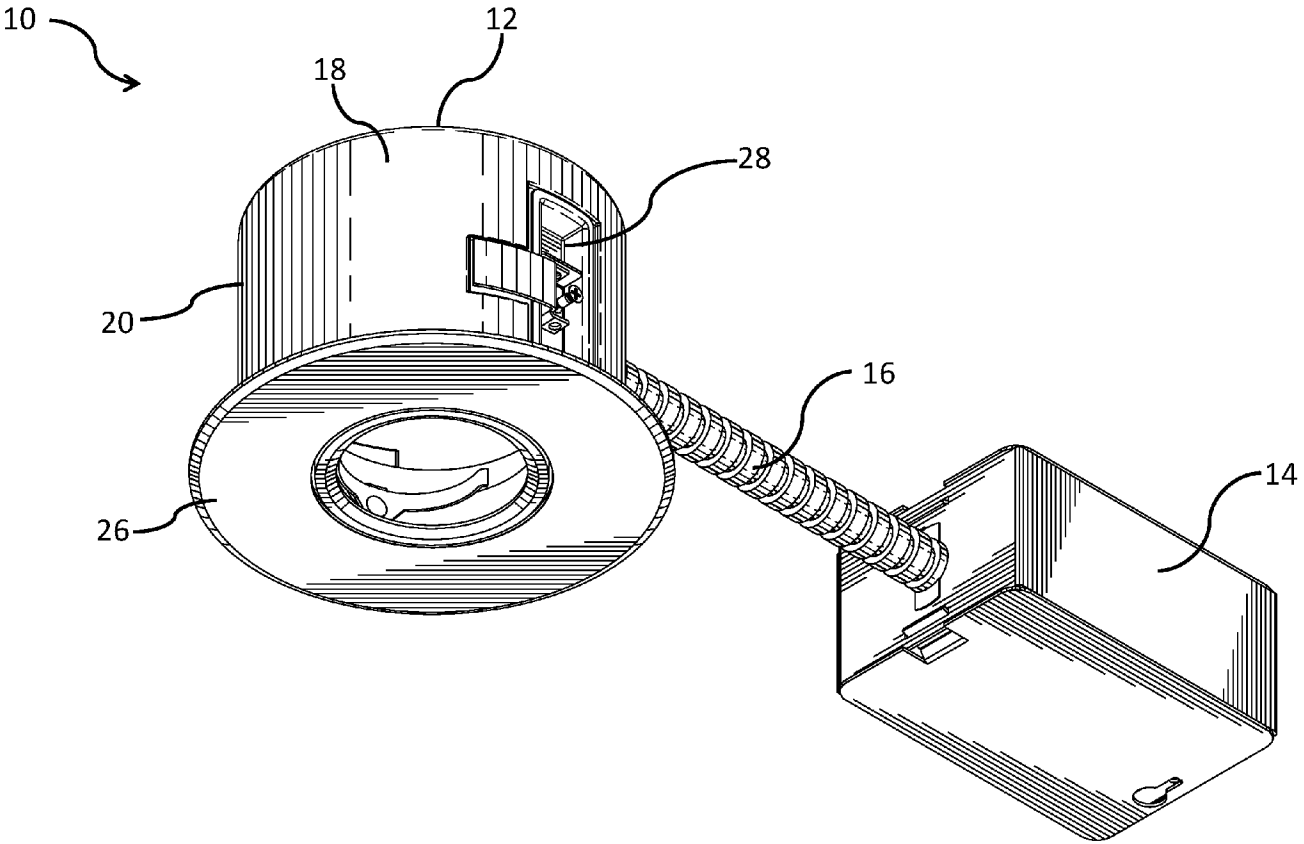
FIG. 1A is an isometric perspective bottom view of a recessed light fixture, in accordance with a preferred embodiment of the invention.
Figure 1B:
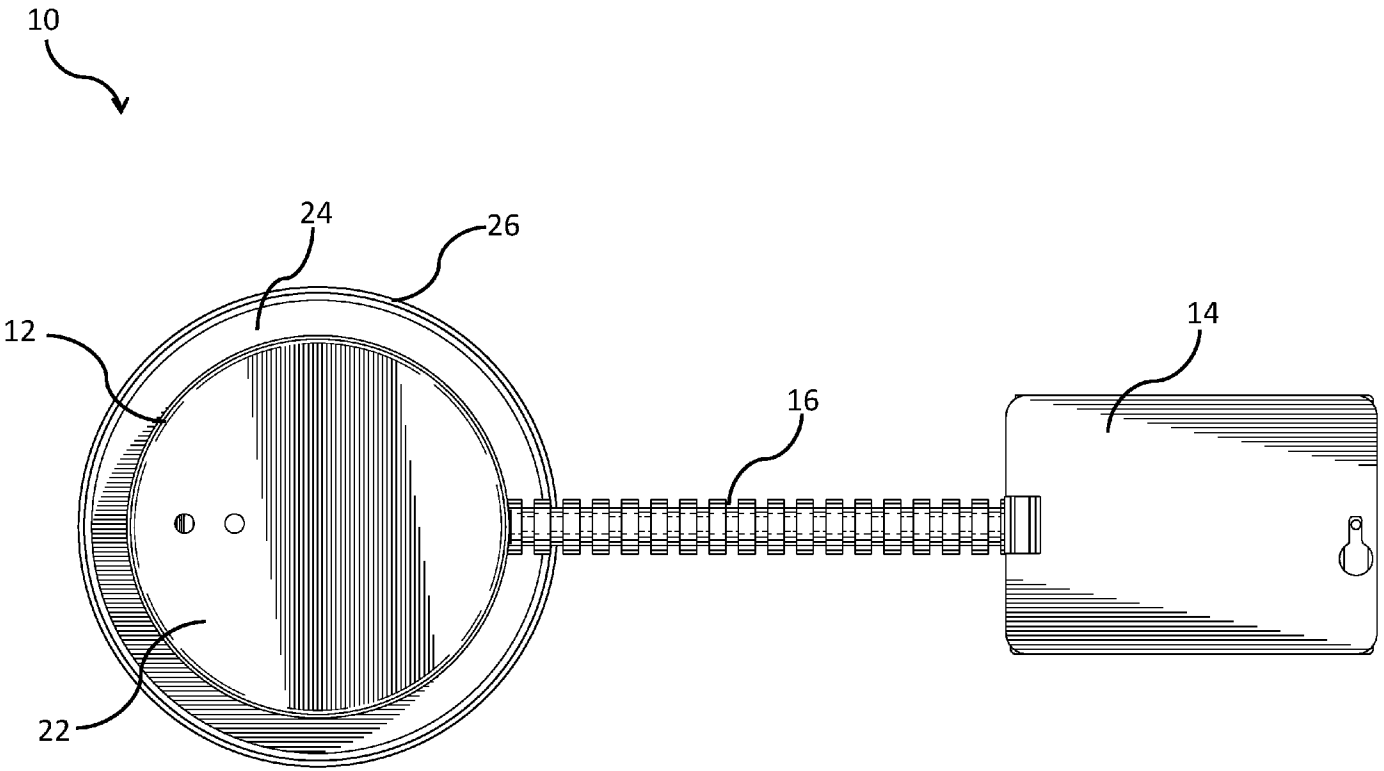
FIG. 1B is a top view of the recessed light fixture shown in FIG. 1A.

With reference to FIGS. 1A and 1B, a light fixture assembly 10 is displayed. The light fixture assembly 10 comprises a recessed light fixture 12, a supply unit 14 and a cable duct 16 extending between the recessed light fixture 12 and the supply unit 14 and providing for a protected electric connection between the two.

The recessed light fixture 12 comprises a metal housing 18 of a generally hat-like shape defining an open bottom end and a closed top end. In an embodiment, the housing 18 is made of steel with rust protection. The housing 18 comprises a first wall 20 of generally cylindrical shape extending between the open and closed ends. A second wall 22 is of a circular disc shape and defines the closed end of the housing 18. The housing 18 further comprises an annular shoulder or collar 24 for abutting a mounting wall (not shown), for example a ceiling, into which the recessed light fixture 12 may be installed. The collar 24 is positioned at the open end of the housing 18 and extends radially and substantially perpendicular to the first wall 20. A cover member 26 is attached to the housing 18 at the open end. The recessed light fixture 12 can be fixed to the mounting wall by means of at least one fixation assembly 28, which will be described in more detail with reference to FIG. 3.

Figure 2:
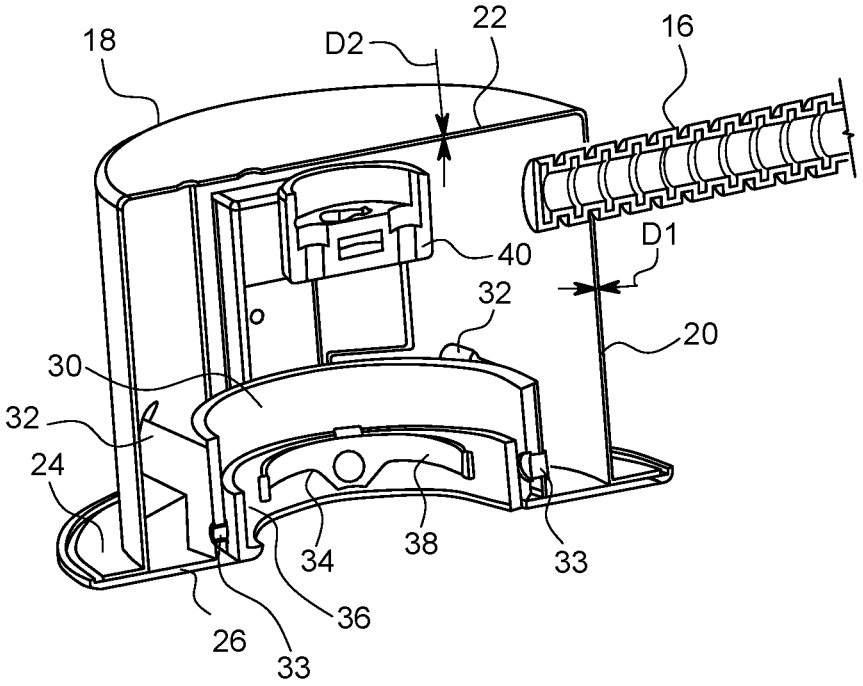
FIG. 2 is an isometric sectional view of the recessed light fixture shown in FIG. 1A.

Now with reference to FIG. 2, the cover member 26 comprises a cylindrical wall portion 30 and two engagement hooks 32 fixed to the cylindrical wall portion 30 with respective fixation elements 33. Each engagement hook 32 engages with the first wall 20, for example at an engagement shoulder (not shown), to hold the cover member 26 in an installed position, as shown. In this installed position, the cover member 26 covers the housing 18 at the open end and provides for an aesthetic appearance of the recessed light fixture 12.

The cylindrical wall portion 30 comprises two pivots 34, one of which can be seen in FIG. 2. A tilting ring 36 is connected to the cylindrical wall portion 30 by means of the pivots 34, such that the tilting ring 36 can rotate or tilt about the pivots 34. The tilting ring 36 carries a clip 38 for receiving a light source (not shown), for example a halogen or LED spot light, and holding it in place relative to the tilting ring 36. FIG. 2 also shows a socket 40 for the light source. The socket 40 can be connected to the supply unit 14, shown in FIG. 1, by means of cables leading through the cable duct 16.

The first wall 20 of the housing 18 has a first wall thickness D1 of a value between 0.5 mm and 1 mm. In an embodiment, the first wall thickness D1 has a value of 0.75 mm. The second wall 22 has a second wall thickness D2 of a value between 0.5 cm and 1 mm. In an embodiment, the second wall thickness D2 has a value of 0.75 mm. In an embodiment, the second wall thickness D2 is substantially equal to the first wall thickness D1. The given values for D1 and D2 ensure that high temperatures or fire are prevented from propagating quickly through the housing 18 and, thus, make the recessed light fixture 12 fireproof, for example in accordance with ASTM E119, at least for a certain period of time, for example two hours. However, further fireproofing measures may be taken to further improve the fire resistance of the recessed light fixture 12. For example, the walls 20 and 22 may additionally be coated with an intumescent, in particular at an interior surface of the respective walls 20 and 22.

Figure 3:
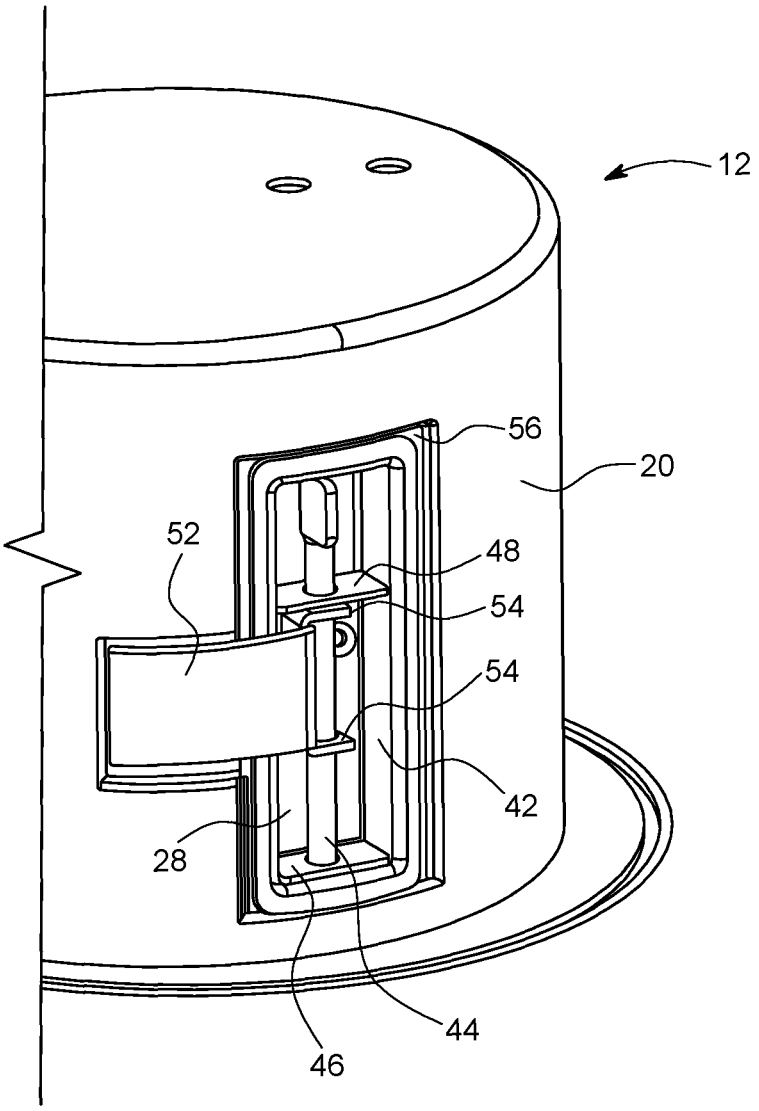
FIG. 3 is an isometric detailed view of the recessed light fixture shown in FIG. 1A.

In FIG. 3, the fixation assembly 28 is shown in more detail. The fixation assembly 28 includes a box 42 bearing a screw 44 by means of a bottom box wall 46 and a rib 48, such that the screw 44 can rotate about a screw axis. The screw 44 comprises a screw head 50, which can be seen in FIG. 4, for driving the screw 44 about its screw axis. The fixation assembly 28 further comprises a wing 52 having two flaps 54. Each flap 54 comprises a threaded bore to engage with the screw 44. Upon rotation of the screw 44, the wing 52 rotates together with the screw 44 into a substantially radial position of the wing 52 until a stop (not shown) is reached. Upon reaching the stop and upon further rotation of the screw 44, the wing 52 moves along the screw axis 44, in FIG. 3 downwards, until engaging with a mounting wall (not shown), into which the recessed light fixture 12 is installed, thereby fixing the recessed light fixture 12 in the mounting wall. The fixation assembly 28 that is located externally with respect to the housing 18 is air tight or sealed with respect to the inside of the housing 18.

Figure 4:
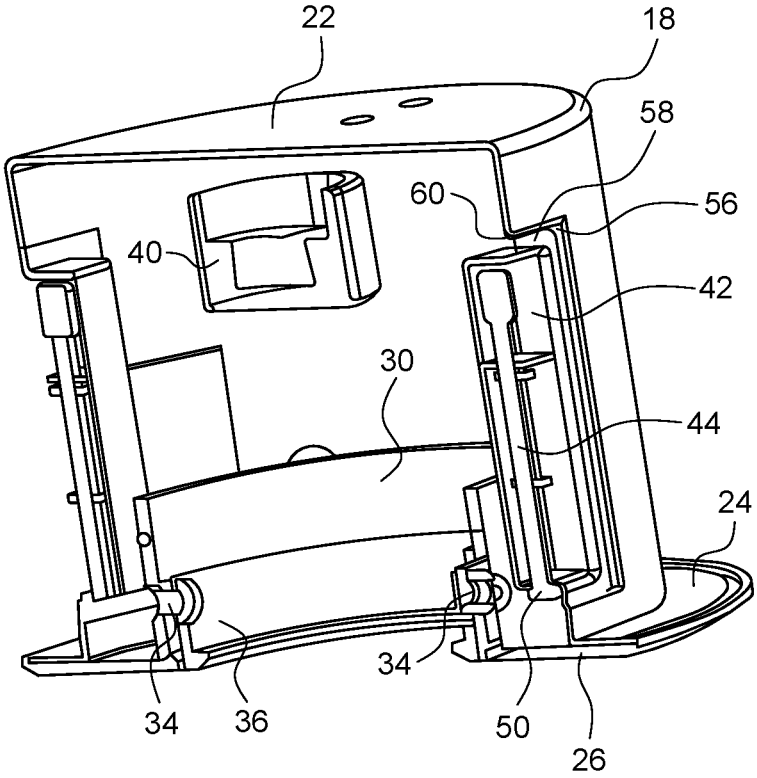
FIG. 4 is another isometric sectional view of the recessed light fixture shown in FIG. 1A.

As can be best seen in FIG. 4, the box 42 is received in a recessed 56 of the first wall 20. An annular collar 58 of the box 42 engages with a shoulder 60 of the recess, such that the box 42 covers and essentially seals the recessed 56. Thereby, the fire resistance of the recessed light fixture 12 can be further improved. Tape may also be applied to the different parts to further improve the sealing.

Referring now to FIG. 5, there is shown the results of a fire endurance test of the recessed light fixture 12. In order to achieve a 2 hour fire endurance rating as per ASTM E119 standards, the recessed light fixture was mounted in a ceiling assembly and placed into a horizontal furnace. The 4' by 4' ceiling assembly consisted of 10" steel "C" joists spaced 16" off center, 20 gauge corrugated steel deck, and a 2" thick concrete slab, acting as an unexposed surface, on top of the corrugated steel deck. Ten thermocouple (T/C) temperature sensors were placed in various locations to record ambient temperature, furnace temperature, and unexposed surface temperature. The furnace was heated following the standard ASTM E119 time-temperature curve. The average temperature of the unexposed surface of the concrete slab after 2 hours was 158° F. with a high unexposed surface temperature of 168° F., whereas the allowable limit was 312° F. Thus, the recessed light fixture achieved a 2 hour fire endurance rating as per ASTM E119 standards.

The scope of the claims should not be limited by the preferred embodiments set forth in the examples, but should be given the broadest interpretation consistent with the description as a whole.

The invention claimed is:

1. A fireproof recessed light fixture (12) for receiving at least one light source, the fireproof recessed light fixture (12) comprising:

a metal housing (18) defining an open end, through which the light source can be received, and a closed end, said housing (18) further comprising an annular shoulder (24) at said open end for abutting a wall into which the recessed light fixture can be installed;

wherein said housing (18) comprises a first wall (20) of generally cylindrical shape extending between said open and closed ends, said first wall (20) having a first wall thickness between 0.5 mm and 1 mm;

wherein said housing (18) comprises a second wall (22) defining said closed end of said housing (18), said second wall (22) having a second wall thickness between 0.5 mm and 1 mm;

wherein said first and second walls (20, 22) are sealed so as to prevent air flow between an interior of said housing (18) and an exterior of said housing (18) other than through said open end and through an opening for feeding through cables for electrical energy supply; and wherein said first and second walls (20, 22) fireproof the recessed light fixture (12) by preventing high temperatures or fire from propagating quickly through said housing (18), said recessed light fixture comprising a fixation assembly (28) for mounting the recessed light fixture (12) on a mounting wall, the fixation assembly (28) comprising:

a box (42) bearing a screw (44) by means of a bottom box wall (46) and a rib (48), said screw (44) being rotatable about a screw axis, said screw (44) comprising a screw head (50) for driving said screw (44) about said screw axis; and a wing (52) comprising two flaps (54), each of said flaps (54) comprising a threaded bore engageable with said screw (44);

wherein upon rotation of said screw (44), said wing (52) rotates together with said screw (44) into a substantially radial position of said wing (52) until a stop is reached; and wherein upon reaching said stop and upon further rotation of said screw (44), said wing (52) moves along said screw axis until engaging with the mounting wall.

2. The recessed light fixture of claim 1, further comprising a cover (26) member for covering at least said annular shoulder (24) of said housing (18).

3. The recessed light fixture of claim 1, wherein said first wall thickness is between 0.60 mm and 0.80 mm.

4. The recessed light fixture of claim 3, wherein said first wall thickness is about 0.75 mm.

5. The recessed light fixture of claim 1, wherein said second wall thickness is between 0.60 mm and 0.80 mm.

6. The recessed light fixture of claim 5, wherein said second wall thickness is about 0.75 mm.

7. The recessed light fixture of claim 1, wherein the values of said first wall thickness and said second wall thickness are substantially equal.

8. A fireproof recessed light fixture for receiving at least one light source, the fireproof recessed light fixture (12) comprising:

a metal housing (18) defining an open end, through which the light source can be received, and a closed end, said housing (18) further comprising an annular shoulder (24) at said open end for abutting a wall into which the recessed light fixture can be installed;

wherein said housing (18) comprises a first wall (20) of generally cylindrical shape extending between said open and closed ends, said first wall (20) having a first wall thickness between 0.5 mm and 1 mm;

wherein said housing (18) comprises a second wall (22) defining said closed end of said housing (18), said second wall (22) having a second wall thickness between 0.5 mm and 1 mm;

wherein said first and second walls (20, 22) are sealed so as to prevent air flow between an interior of said housing (18) and an exterior of said housing (18) other than through said open end and through an opening for feeding through cables for electrical energy supply; and wherein said first and second walls (20, 22) fireproof the recessed light fixture (12) by preventing high temperatures or fire from propagating quickly through said housing (18), the recessed light fixture comprising a fixation assembly (28) for mounting the recessed light fixture (12) on a mounting wall, said fixation assembly (28) being sealed or air tight with respect with an interior of the housing (18) when installed, the fixation assembly (28) comprising:

a box (42) bearing a screw (44) by means of a bottom box wall (46) and a rib (48), said screw (44) being rotatable about a screw axis, said screw (44) comprising a screw head (50) for driving said screw (44) about said screw axis; and a wing (52) comprising two flaps (54), each of said flaps (54) comprising a threaded bore engageable with said screw (44);

wherein upon rotation of said screw (44), said wing (52) rotates together with said screw (44) into a substantially radial position of said wing (52) until a stop is reached; and wherein upon reaching said stop and upon further rotation of said screw (44), said wing (52) moves along said screw axis until engaging with the mounting wall.

* * * * *